United States Patent [19]

Oswald et al.

[11] Patent Number: 4,784,040

[45] Date of Patent: Nov. 15, 1988

[54] CONTROL SYSTEM FOR EXPELLING LIQUID FROM A PNEUMATIC ACTUATOR

[75] Inventors: Charles W. Oswald, Decatur; James M. Stanley, Oreana, both of Ill.

[73] Assignee: Caterpillar Inc., Peoria, Ill.

[21] Appl. No.: 86,341

[22] Filed: Aug. 18, 1987

[51] Int. Cl.[4] ..... F15B 11/08; F15B 21/04

[52] U.S. Cl. ..... 91/461; 92/43; 92/79; 92/87

[58] Field of Search ..... 92/43, 34, 59, 60.5, 92/79; 91/461

[56] References Cited

U.S. PATENT DOCUMENTS

| | | | |
|---|---|---|---|
| 2,973,133 | 2/1961 | Newton | 92/43 |
| 3,361,037 | 1/1968 | Likavec | 92/43 |
| 4,006,329 | 2/1977 | Hellman | 92/43 |
| 4,016,936 | 4/1977 | Easterling | 91/461 |
| 4,227,444 | 10/1980 | Lincicome | 92/43 |

*Primary Examiner*—Abraham Hershkovitz
*Attorney, Agent, or Firm*—Calvin E. Glastetter

[57] ABSTRACT

A control system for a pneumatic actuator uses pressurized gases, such as air, as the actuating medium. Such gases and particularly air commonly contain moisture which condenses to form a liquid, such as water, which collects in a closed chamber of an expandable chamber assembly in the pneumatic actuator. In cold climates, the water freezes, preventing proper control of the pneumatic actuator. By providing a control system having a valve positioned elevationally higher or in close proximity to a pneumatic actuator and a tube which extends into the closed chamber of the expandable chamber assembly, water which is contained in the closed chamber is expelled from the elevationally lowest portion of the assembly when the valve is shifted to exhaust the air from the control system.

2 Claims, 1 Drawing Sheet

CONTROL SYSTEM FOR EXPELLING LIQUID FROM A PNEUMATIC ACTUATOR

DESRIPTION

1. Technical Field

This invention relates generally to a control system for controlling a pneumatic actuator, and more particularly to expelling liquid which collects in the pneumatic actuator.

2. Background Art

Control systems which control pneumatic actuators use pressurized gases, such as air, as the actuating medium. Such gases and particularly air commonly contain moisture which condenses and forms a liquid, such as water, which collects in a closed chamber of an expandable chamber assembly in the pneumatic actuator. In cold conditions, the water in the closed chamber will freeze and prevents the expandable chamber assembly from operating properly. A problem encountered with such systems is when the air is exhausted from the closed chamber it is exhausted from the elevationally highest portion. Exhausting the air from the elevationally highest portion does not expel the liquid, which collects in the elevationally lowest portion. A further aspect of the problem is a valve used for exhausting the air is positioned elevationally higher, or is spaced from the pneumatic actuator and does not completely expel the liquid from the connecting conduits. The present invention overcomes one or more of the problems set forth above.

DISCLOSURE OF THE INVENTION

In one aspect of the present invention, a control system is used to expel the liquid from a pneumatic actuator. The control system includes a means for supplying pressurized gas to extend an expandable chamber assembly in a pneumatic actuator and exhausting the pressurized gas to allow the expandable chamber assembly to retract and expel the pressurized gas and liquid from a closed chamber. The means includes a valve having a first position for supplying the pressurized gas to the expandable chamber assembly and a second position for exhausting the pressurized gas from the expandable chamber assembly. The means further includes a tube having a first end connected to the valve and a second end portion extending into the closed chamber and being positioned in close proximity to the elevationally lowest portion of the closed chamber when the expandable chamber assembly is in the retracted position.

The pressurized gas commonly used by the control system for a pneumatic actuator contains moisture which condenses and forms water which collects in a closed chamber of an expandable chamber assembly. In cold conditions the water will freeze and prevent the expandable chamber assembly from operating properly. The present control system uses a tube extending into the closed chamber of the expandable chamber assembly to expel the water along with the air exhausted from the closed chamber of the pneumatic actuator. Expelling of the water prevents the water from freezing in the closed chamber of the expandable chamber assembly and preventing proper operation of the pneumatic actuator.

BEST MODE FOR CARRYING OUT THE INVENTION

Figure 1:
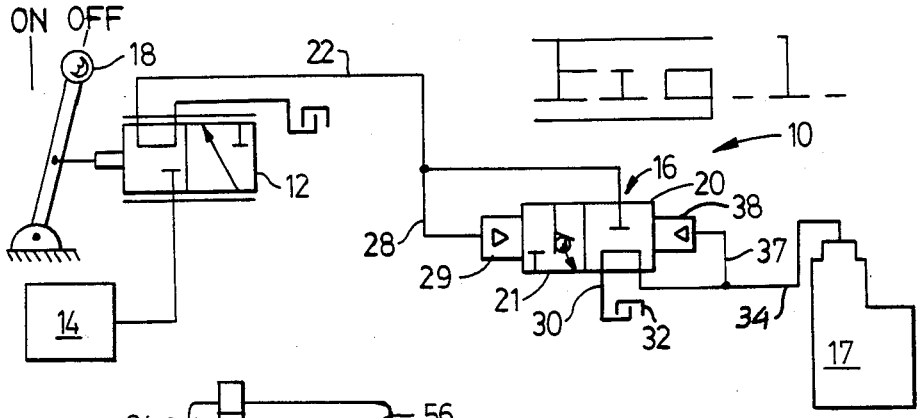
FIG. 1 is a schematic of a pneumatic control system.

With reference to FIG. 1, a pneumatic control system 10 has a main control valve 12, a source of pressurized gas 14, a valve 16, and a pneumatic actuator 17. The main control valve 12 is movable between ON and OFF positions by a control lever 18, and is operative to controllably direct pressurized gases, such as air, from the source 14 to the valve 16.

The valve 16 can be, for example, a two position three-way valve of the pilot operated type. The valve has a first position 20 and a second position 21. A conduit 22 connects the main control valve 12 to the valve 16. A pilot conduit 28 connects the conduit 22 to a first pilot actuator 29 having a predetermined effective area at one end of the valve 16. A conduit 30 connects the valve 16 to a vent port 32 when the valve 16 is in the first position 20. A conduit 34 connects the valve 16 to the pneumatic actuator 17. A pilot conduit 37 connects the conduit 34 to a second pilot actuator 38 at the other end of the valve 16 and having an effective area less than that of the first pilot actuator 29.

Figure 2:
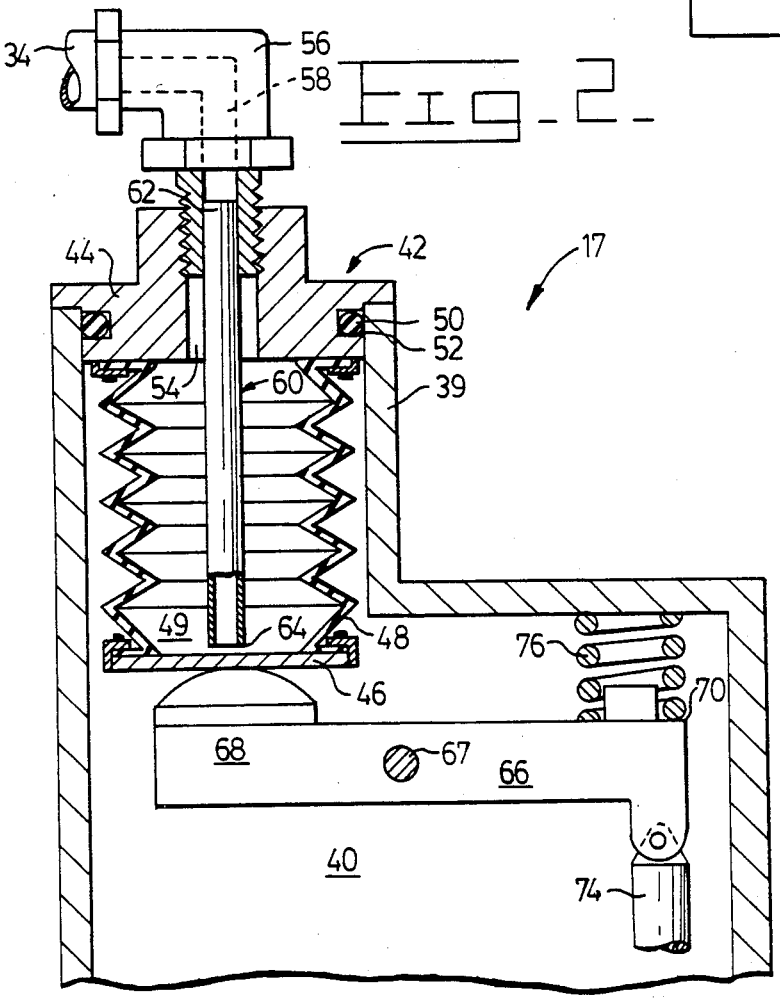
FIG. 2 is a diagrammatic sectional view of the pneumatic actuator.

With reference to FIG. 2, the pneumatic actuator 17 has a housing 39 defining a cavity 40. An expandable chamber assembly 42, such as a bellows assembly, is positioned in the cavity 40 of the housing 39 and includes an upper plate 44, a lower plate 46, and a pleated bellows portion 48 having one end suitably connected to the upper plate 44 and the other end suitably connected to the lower plate 46. A closed chamber 49 is defined by the connection of the plates 44, 46 and the pleated bellows portion 48. The pleated bellows portion 48 and lower plate 46 are movable together between an extended and retracted position. The lower plate 46 is the elevationally lowest portion of the closed chamber 49. An O-ring seal 50 is positioned in a groove 52 of the upper plate 44 and is operative to seal the cavity 40. The upper plate 44 has a threaded bore 54. An L-shaped fitting 56 having an internal passage 58 is screw threadably fastened into the threaded bore 54 of upper plate 44. A tube 60 has a first end portion 62 secured in the internal passage 58 of the fitting 56. Alternately the tube 60 may be secured to the plate 44. The tube 60 extends downwardly a predetermined distance from the fitting 56 and terminates at a distal or second end portion 64. The expandable chamber assembly 42 has a retracted position at which the lower plate 46 is in close proximity to the distal end 64 of the tube 60 and an extended position at which the lower plate 46 is spaced from the distal end 64 of the tube 60. The valve 16 and the tube 60 define a means 65 for supplying and exhausting the pressurized gas from the closed chamber 49 of the expandable chamber assembly 42.

An actuating lever 66 is pivotally attached to the housing 39 by a pin 67. The actuating lever 66 has a first end portion 68 which abuts the lower plate 46 of the expandable chamber assembly 42 and a second end portion 70. An actuating rod 74 is attached to the second end portion 70 of the actuating lever 66 for positioning an adjusting mechanism (not shown). A spring 76 exerts a downward force on the second end portion 70 of the actuating lever 66 in opposition to the force from the expandable chamber assembly 42.

Although the valve 16 is shown as a two position pilot operated valve having differential areas for controlling the position of the valve, it is understood that the valve 16 can be controlled in other ways, such as, manually or electrically, without departing from the aspects of the invention.

INDUSTRIAL APPLICABILITY

The control system 10 is particularly suitable for expelling liquid, such as water, from a pneumatic actuator 17.

In operation the control lever 18 is moved toward the ON position to move the main control valve 12 and modulate pressurized air from the source 14 to the conduits 22,28 and the first pilot actuator 29 of the valve 16. Modulated pressurized air in the first pilot actuator 29 shifts the valve 16 to its second position 21 allowing pressurized air in conduit 22 to pass through the valve 16 into the conduit 34. Air in the conduit 34 passes through the passage 58 and the tube 60 exiting the distal end portion 64 to extend the expandable chamber assembly 42. Expansion of the expandable chamber assembly 42 pushes down on the first end portion 68 of the actuating lever 66 with sufficient force to overcome the biasing force of the spring 76, causing the lever 66 to pivot about the pin 72. Pivoting of lever 66 pulls the actuating rod 74 upward to position the adjusting mechanism.

To move the actuating rod 74 downward and reposition the adjusting mechanism, the control lever 18 is moved to the OFF position to block the flow of pressurized air from the air source 14 through the main control valve 12 and vent the conduits 22,28, and the first pilot actuator 29. The loss of air in the pilot actuator 29 allows the pressurized air in conduit 37 and pilot actuator 38 to shift the valve 16 to its first position 20. At the first position 20 of the valve 16, the pressurized air in the closed chamber 49 of the expandable chamber assembly 42 is exhausted out the vent port 32 to atmosphere by way of the tube 60, the passage 58, the conduit 34, the valve 16, and the conduit 30. As the pressure of the air in the closed chamber 49 of the expandable chamber assembly 42 decreases the spring 76 pivots the actuating lever 66 causing the first end portion 68 to retract the expandable chamber assembly 42. As the expandable chamber assembly 42 moves toward the retracted position the air and the liquid in the closed chamber 49 enters the distal end 64 of the tube 60 at the elevationally lowest portion of the closed chamber 49 to be expelled to atmosphere by the valve 16. With the valve being elevationally lower or in close proximity to the actuator 17 the vent port 32 is elevationally lower than the pneumatic actuator 17 to provide a natural drain or the conduit 34 is relatively short, thus insuring more complete expelling of the liquid and prevents liquid from remaining in the conduits 34 and 37.

Other aspects, objects and advantages of this invention can be obtained from a study of the drawings, the disclosure, and the appended claims.

We claim:

1. A control system for controlling the flow of a pressurized gas to and from a closed chamber of an expandable chamber assembly of a pneumatic actuator and for expelling from the closed chamber liquid formed by the condensation of moisture contained in the pressurized gas, comprising:

means for supplying the pressurized gas to extend the expandable chamber assembly in the pneumatic actuator and exhausting the pressurized gas to allow the expandable chamber assembly to retract and expel the pressurized gas and the liquid from the closed chamber, said means includes a valve having a first position for supplying the pressurized gas to the expandable chamber assembly and a second position for exhausting the pressurized gas from the expandable chamber assembly, said means further includes a tube having a first end portion suitably connected to the expandable chamber and a second end portion extending a predetermined distance into the closed chamber of the expandable chamber assembly, said pneumatic actuator being oriented with the second end portion of the tube being positioned in close proximity to the elevationally lowest portion of the closed chamber when the expandable chamber assembly is in the retracted position.

2. The control system of claim 1 wherein the second end portion of the tube extends downwardly a predetermined distance and is spaced from the elevationally lowest portion of the closed chamber when the expandable chamber assembly is in the extended position.

* * * * *